US007371096B2

(12) United States Patent
Goodman et al.

(10) Patent No.: US 7,371,096 B2
(45) **Date of Patent: *May 13, 2008**

(54) HERMAPHRODITIC SOCKET/ADAPTER

(75) Inventors: Glenn Goodman, Cumberland, RI (US); James V. Murphy, North Kingston, RI (US)

(73) Assignee: Advanced Interconnections Corporation, West Warwick, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/707,604

(22) Filed: Feb. 16, 2007

(65) Prior Publication Data

US 2007/0202731 A1 Aug. 30, 2007

Related U.S. Application Data

(63) Continuation of application No. 10/935,880, filed on Sep. 8, 2004, now Pat. No. 7,179,108.

(51) Int. Cl.
*H01R 13/28* (2006.01)

(52) U.S. Cl. ..... 439/284

(58) Field of Classification Search ..... 439/284, 439/74, 75, 292, 291, 331, 332, 70
See application file for complete search history.

(56) References Cited

U.S. PATENT DOCUMENTS

| | | | |
|---|---|---|---|
| 2,124,207 | A | 7/1938 | Neesen |
| 2,384,267 | A | 9/1945 | Andersen |
| 2,437,358 | A | 3/1948 | Mowery |
| 2,465,419 | A | 3/1949 | Barany |
| 3,432,795 | A | 3/1969 | Jayne |
| 3,582,867 | A | 6/1971 | Thompson et al. |
| 4,442,938 | A | 4/1984 | Murphy |
| RE32,540 | E | 11/1987 | Murphy |
| 5,038,467 | A | 8/1991 | Murphy |
| 5,088,930 | A | 2/1992 | Murphy |
| 5,125,848 | A | 6/1992 | Zimmerly |
| 5,227,718 | A | 7/1993 | Stowers et al. |
| 5,306,171 | A | 4/1994 | Marshall |
| 5,356,300 | A | 10/1994 | Costello et al. |
| 5,420,519 | A | 5/1995 | Stowers et al. |
| 5,545,050 | A | 8/1996 | Sato et al. |
| 5,576,631 | A | 11/1996 | Stowers et al. |
| 5,877,554 | A | 3/1999 | Murphy |
| 6,020,635 | A | 2/2000 | Murphy |
| 6,065,992 | A | 5/2000 | Wu et al. |
| 6,074,236 | A | 6/2000 | Wu |
| 6,213,787 | B1 | 4/2001 | Murphy |
| 6,299,492 | B1 | 10/2001 | Pierini et al. |
| 6,313,530 | B1 | 11/2001 | Murphy |
| 6,352,437 | B1 | 3/2002 | Tate |
| 6,471,524 | B1 | 10/2002 | Nakano |
| 6,896,523 | B2 | 5/2005 | Nishizawa et al. |
| 7,179,108 | B2 * | 2/2007 | Goodman et al. ..... 439/284 |

* cited by examiner

*Primary Examiner*—Phuong Dinh
(74) *Attorney, Agent, or Firm*—Occhiuti Rohlicek & Tsao LLP

(57) ABSTRACT

A hermaphroditic terminal assembly for connecting electrical devices includes an insulating support member for supporting female sockets and male pins, a number of female sockets, and a number of male pins. An intercoupling component for connecting electrical devices includes two hermaphroditic terminal assemblies configured such that the first hermaphroditic terminal assembly can be mated with the second hermaphroditic terminal assembly.

20 Claims, 4 Drawing Sheets

HERMAPHRODITIC SOCKET/ADAPTER

CROSS-REFERENCE TO RELATED APPLICATIONS

This application is a continuation of U.S. application Ser. No. 10/935,880, filed Sep. 8, 2004 now U.S. Pat. No. 7,179,108, the entire contents of which are incorporated herein by reference.

TECHNICAL FIELD

This invention relates to making electrical connections between electrical devices.

BACKGROUND

Electrical connection pins are a popular means for connecting two electrical devices. For example, integrated circuit (IC) packages typically possess a number of male electrical connection pins for mounting the IC package an electrical socket on a printed circuit board (PCB). Each of the male electrical connection pins of the IC package is inserted into corresponding female sockets in the electrical socket on the PCB. As technology continues to advance, the size of electrical devices continues to decrease while the number of connections required between electrical devices continues to increase. Consequently, increasing the density of electrical connection terminals for electrically connecting two electrical devices is necessary.

SUMMARY

The invention relates to a terminal assembly for electrically connecting two electrical devices. In one aspect of the invention, the terminal assembly includes an insulating support member for supporting female sockets and male pins; a number of female sockets received within a first array of apertures in the insulating support member, each aperture extending from the upper surface of the insulating support member to the bottom surface of the insulating support member; and a number of male pins received within a second array of apertures in the insulating support member, each aperture extending from the upper surface of the insulating support member to the bottom surface of the insulating support member.

Preferred embodiments of this aspect of the invention may include one or more of the following features. The female sockets and male pins are arranged in a pattern such that each interstitial space between the sockets is occupied by a pin and each interstitial space between the pins is occupied by a socket. The terminal assembly is used to electrically connect a first circuit board to a second circuit board. The terminal assembly is used to electrically connect an IC package to a circuit board. The height of at least one of the male pins is different than the height of every other pin. The terminal assembly includes at least one alignment element to align the female sockets and male pins with corresponding male pins and female sockets on a second terminal assembly. For example, the terminal assembly includes at least one alignment guide post or at least one alignment guide hole. The alignment guide post is capable of serving as an electric power, voltage, or ground connection. In these embodiments, the alignment guide posts are advantageously dual-purposed: serving to both align electrical connections between electrical devices as well as to provide an electrical path themselves. The terminal assembly further includes a member that applies a downward force on the terminal assembly and to each pin and socket.

In another aspect of this invention, an intercoupling component for electrically connecting two electrical devices includes two terminal assemblies of the type described above. The two terminal assemblies are used to electrically connect two electrical devices by inserting the male pins of the first terminal assembly into the female sockets of the second terminal assembly and by inserting the male pins of the second terminal assembly into the female sockets of the first terminal assembly.

Among other advantages, intercoupling components having the structure discussed above provides all of the advantages associated with traditional socket/adapter technology (e.g., non-permanent connections) while providing a substantial increase in the density of electrical connections between electrical devices or substrates (e.g., printed circuit boards) having electrical connections.

Preferred embodiments of this aspect of the invention may include one or more of the following features. The female sockets and male pins of the first terminal assembly are arranged in a pattern such that each interstitial space between the sockets is occupied by a pin and each interstitial space between the pins is occupied by a socket. The female sockets and male pins of the second terminal assembly are arranged in a pattern corresponding to the pattern of the female sockets and male pins of the first terminal assembly such that each interstitial space between the sockets is occupied by a pin and each interstitial space between the pins is occupied by a socket. The intercoupling component is used to electrically connect a first circuit board to a second circuit board. The intercoupling component is used to electrically connect an IC package to a circuit board.

In certain embodiments, the first terminal assembly is identical to the second terminal assembly. The height of at least one of the male pins of the first terminal assembly is different than the height of every other pin of the first terminal assembly. The height of at least one of the male pins of the second terminal assembly is different than the height of every other pin of the second terminal assembly. Both the first terminal assembly and the second terminal assembly include at least one alignment element each to align the female sockets and male pins of the first terminal assembly with corresponding male pins and female sockets of the second terminal assembly. For example, the first terminal assembly includes at least one alignment guide post that is inserted into at least one alignment guide hole in the second terminal assembly. The alignment guide post is capable of serving as an electric power, voltage, or ground connection. The intercoupling component further includes a member that applies a downward force on the intercoupling component.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
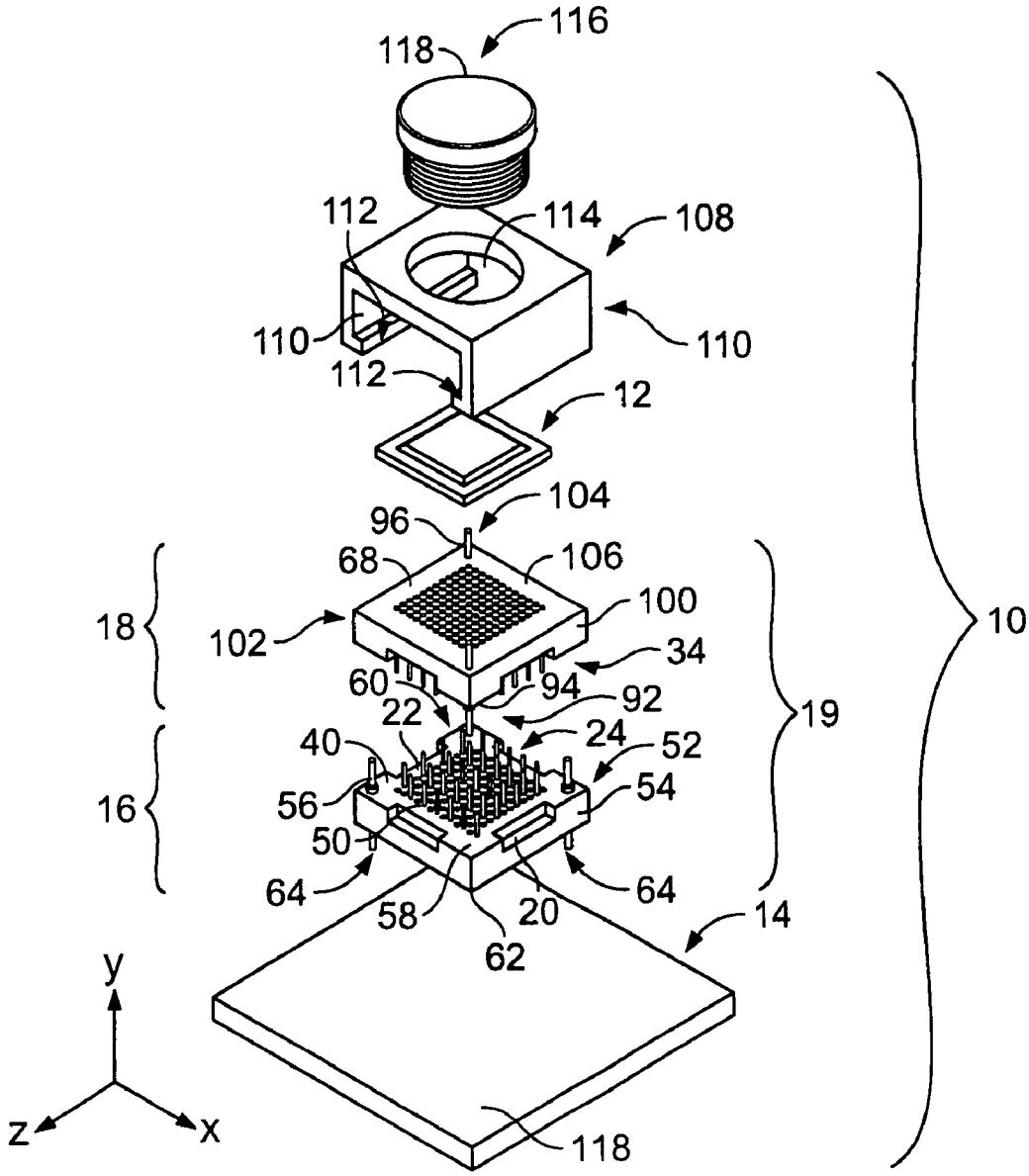
FIG. 1 is an exploded, isometric view of an intercoupling component including two hermaphroditic terminal assemblies, an IC package, and a hold-down assembly positioned over a printed circuit board.
Figure 2A:
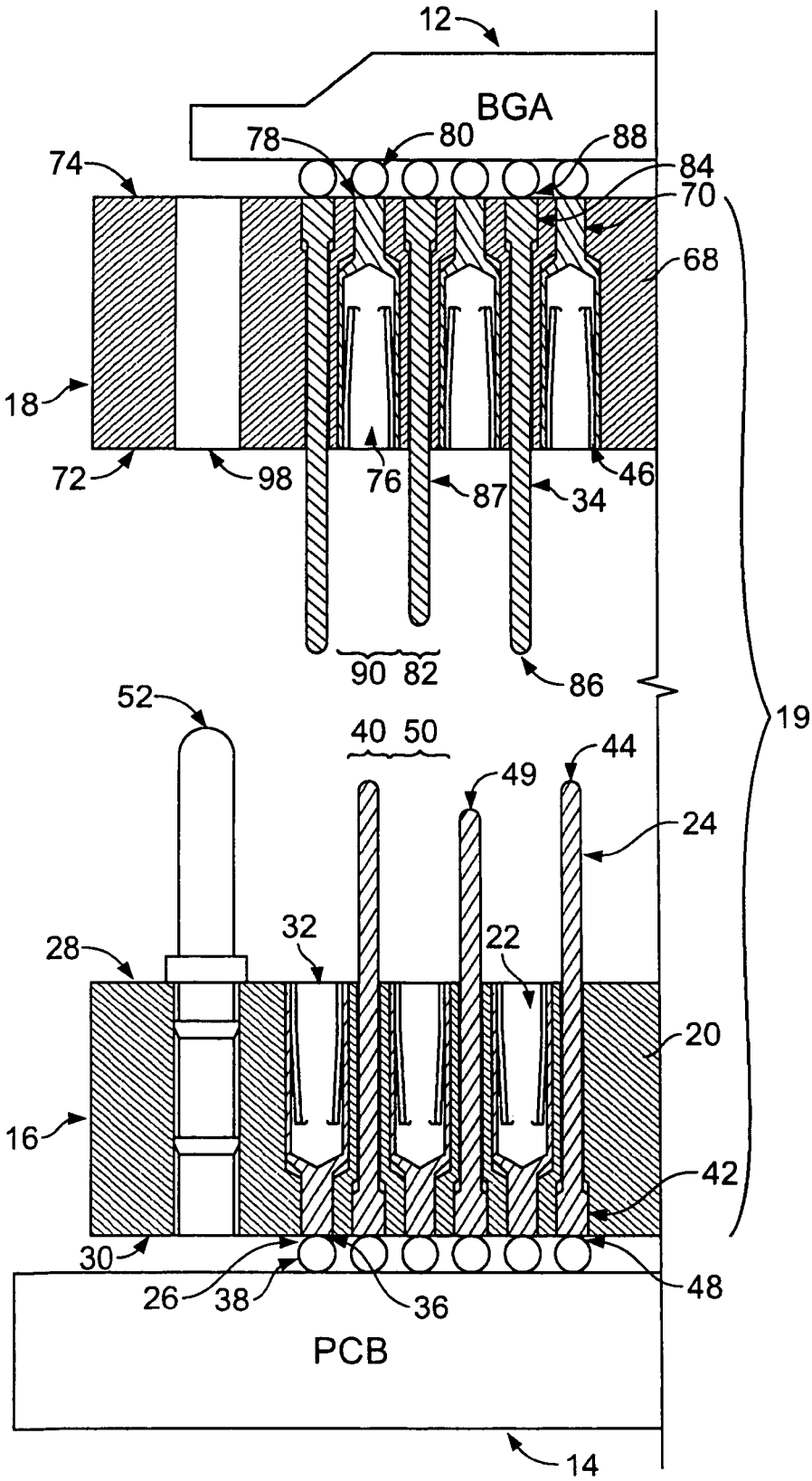
FIGS. 2A-2B are cross-sectional side views of a portion of the intercoupling component of FIG. 1.
Figure 2B:
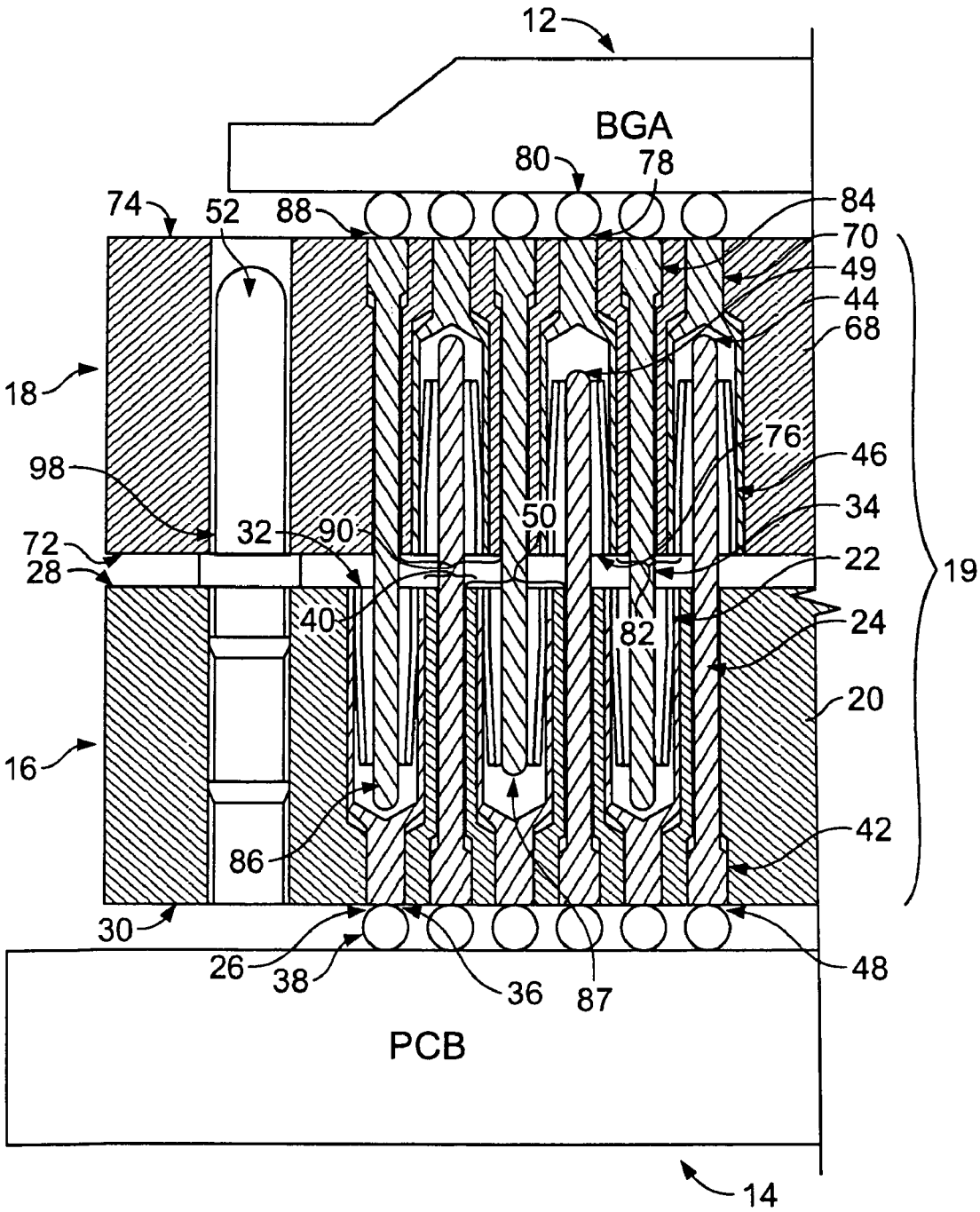

Referring to FIGS. 1, 2A, and 2B, a hermaphroditic socket/adapter assembly 10 for electrically connecting an IC package 12 to a PCB 14 is shown. Hermaphroditic socket/adapter assembly 10, includes a first hermaphroditic terminal assembly 16 and a second hermaphroditic terminal assembly 18 that together comprise an intercoupling component 19.

First hermaphroditic terminal assembly 16 includes an insulating support member 20 for supporting female sockets 22 and male pins 24. Insulating support member 20 includes a first array of apertures 26, extending from the upper surface 28 of insulating support member 20 to the bottom surface 30 of insulating support member 20. Each female socket 22 is received within one aperture 26 of the first array of apertures of the insulating support member 20. Each female socket 22 has a first end 32 configured to receive a corresponding male pin 34 of the second hermaphroditic terminal assembly 18 and a second end 36 attached to a solder ball 38 that establishes an electrical connection with the electrical contact 39 on PCB 14. The female sockets 22 received within the first array of apertures 26 of the insulating support member 20 are arranged such that interstitial spaces 40 exist between the female sockets 22.

Insulating support member 20 also includes a second array of apertures 42, extending from the upper surface 28 of insulating support member 20 to the bottom surface 30 of insulating support member 20. Each male pin 24 is received within one aperture 42 of the second array of apertures of the insulating support member 20. Each male pin has a first end 44 configured to be received within a corresponding female socket 46 of the second hermaphroditic terminal assembly 18 and a second end 48 attached to a solder ball 38 that establishes an electrical connection with electrical contact 39 on PCB 14. In some applications, it may be desirable for at least one male pin 49 to be of a different height than every other male pin 24 where the height of a pin is defined as the length from the first end of the pin 44 to the second end of the pin 48. Varying the height of the pins serves to decrease the force required to insert the first hermaphroditic terminal assembly 16 into a corresponding hermaphroditic terminal assembly. Varying the height of the pins also serves to decrease the force required to extract the first hermaphroditic terminal assembly 16 from a corresponding hermaphroditic terminal assembly into which it has been inserted. The male pins 24 received within the second array of apertures 42 of the insulating support member 20 are arranged such that interstitial spaces 50 exist between the male pins 24. Collectively, the female sockets 22 and the male pins 24 are arranged in a pattern such that the interstitial spaces 40 between the female sockets 22 are occupied by male pins 24, and the interstitial spaces 50 between the male pins 24 are occupied by female sockets 22. It is appreciated that the female sockets 22 and the male pins 24 could be arranged in different patterns.

First hermaphroditic terminal assembly 16 also includes two alignment guide posts 52 located in opposite corners 54, 56 of first hermaphroditic terminal assembly 16 and disposed through the upper surface 28 of the insulating support member 20 and two alignment guide holes 58 located in opposite corners 60, 62 of the upper surface 28 of the insulating support member 20. In addition, first hermaphroditic terminal assembly 16 includes two alignment guide posts 64 located in opposite corners 54, 56 of first hermaphroditic terminal assembly 16 and disposed through the lower surface 30 of the insulating support member 20 and two alignment guide holes (not shown) located in opposite corners 60, 62 of the lower surface 30 of the insulating support member 20.

Second hermaphroditic terminal assembly 18 includes an insulating support member 68 for supporting female sockets 46 and male pins 34. Insulating support member 68 includes a first array of apertures 70, extending from the upper surface 72 of insulating support member 68 to the bottom surface 74 of insulating support member 68. Each female socket 46 is received within one aperture 70 of the first array of apertures of the insulating support member 68. Each female socket 46 has a first end 76 configured to receive a corresponding male pin 24 of the first hermaphroditic terminal assembly 16 and a second end 78 configured to contact a solder ball 80 on IC package 12. The female sockets 46 received within the first array of apertures 70 of the insulating support member 68 are arranged such that interstitial spaces 82 exist between the female sockets 46.

Insulating support member 68 also includes a second array of apertures 84, extending from the upper surface 72 of insulating support member 68 to the bottom surface 74 of insulating support member 68. Each male pin 34 is received within one aperture 84 of the second array of apertures of the insulating support member 68. Each male pin has a first end 86 configured to be received within a corresponding female socket 22 of the first hermaphroditic terminal assembly 16 and a second end 88 configured to contact a corresponding solder ball 80 on IC package 12. In some applications, it may be desirable for at least one male pin 87 to be of a different height than every other male pin 34, where the height of a pin is defined as the length from the first end of the pin 86 to the second end of the pin 88. Varying the height of the pins serves to decrease the force required to insert the second hermaphroditic terminal assembly 18 into a corresponding hermaphroditic terminal assembly. Varying the height of the pins also serves to decrease the force required to extract the second hermaphroditic terminal assembly 18 from a corresponding hermaphroditic terminal assembly into which it has been inserted. The male pins 34 received within the second array of apertures 84 of the insulating support member 68 are arranged such that interstitial spaces 90 exist between the male pins 34. Collectively, the female sockets 46 and the male pins 34 are arranged in a pattern such that the interstitial spaces 82 between the female sockets 46 are occupied by male pins 34, and the interstitial spaces 90 between the male pins 34 are occupied by female sockets 46. It is appreciated that the female sockets 46 and the male pins 34 could be arranged in different patterns.

Second hermaphroditic terminal assembly 18 also includes two alignment guide posts 92 located in opposite corners 94, 96 of second hermaphroditic terminal assembly 18 and disposed through the upper surface 72 of the insulating support member 68 and two alignment guide holes 98 located in opposite corners 100, 102 of the upper surface 72 of the insulating support member 68. In addition, second hermaphroditic terminal assembly 18 includes two alignment guide posts 104 located in opposite corners 94, 96 of second hermaphroditic terminal assembly 18 and disposed through the lower surface 74 of the insulating support member 68 and two alignment guide holes 98 located in opposite corners 100, 102 of the lower surface 74 of the insulating support member 68.

The intercoupling component 19 is used to electrically connect IC package 12 to PCB 14. IC package 12 is secured to the lower surface 74 of insulating support member 68 of the second hermaphroditic terminal assembly 18 such that the solder balls 80 on IC package 12 are brought into contact with the second ends 78 of the female sockets 46 of the second hermaphroditic terminal assembly 18 and the second ends 88 of the male pins 34 of the second hermaphroditic terminal assembly 18. The alignment guide posts 104 disposed through the lower surface 74 the insulating support member 68 of the second terminal assembly can be used to properly align the solder balls 80 on IC package 12 with the second ends 78 of the female sockets 46 of the second hermaphroditic terminal assembly 18 and the second ends 88 of the male pins 34 of the second hermaphroditic terminal assembly 18. It is appreciated that other alignment elements could be used to facilitate proper alignment of the solder balls 80 on IC package 12 with the second ends 78 of the female sockets 46 of the second hermaphroditic terminal assembly 18 and the second ends of the male pins 34 of the second hermaphroditic terminal assembly 18. It is also appreciated that alignment elements are not required to properly align the electrical contacts 80 on IC package 12 with the second ends 78 of the female sockets 46 of the second hermaphroditic terminal assembly 18 and the second ends of the male pins 34 of the second hermaphroditic terminal assembly 18.

Hermaphroditic socket/adapter assembly 10 includes a hold-down cover 108 for securing the IC package 12 to the intercoupling component 19. Hold-down cover 108 includes a pair of opposite walls 110 having tab members 112 that engage the intercoupling component 19. Hold-down cover 108 includes a threaded thru-hole 114 that threadingly receives a heat sink 116 to provide a thermal path for dissipating heat from the IC package 12. Heat sink 116 is inserted through threaded thru-hole 114 and a slot 118 formed in the heat sink 116 facilitates threading the heat sink 116 within the cover, for example, with a screwdriver or coin. It is appreciated that other mechanisms may also be used to secure the IC package 12 to the intercoupling component 19. It is also appreciated that other heat sink arrangements may be substituted for the version shown in FIG. 1. In some applications, a heat sink may not be required. Therefore, it is appreciated that the hold-down cover 108 may be used to secure the IC package 12 to the intercoupling component 19 without a heat sink. It is also appreciated that the hold-down cover itself may not be necessary to secure the IC package 12 to the intercoupling component 19. In some applications, the IC package 12 may be soldered directly to the intercoupling component 19.

The second hermaphroditic terminal assembly 18 is coupled to the first hermaphroditic terminal assembly 16 by inserting each male pin 34 of the second terminal assembly 18 into a corresponding female socket 22 of the first hermaphroditic terminal assembly 16 and inserting each male pin 24 of the first hermaphroditic terminal assembly 16 into a corresponding female socket 46 of the second hermaphroditic terminal assembly 18. When the second hermaphroditic terminal assembly 18 is coupled to the first hermaphroditic terminal assembly 16, it is said to be mated with the first hermaphroditic terminal assembly 16. The alignment guide posts 92 disposed through the upper surface 72 of the insulating support member 68 of the second hermaphroditic terminal assembly 18 are inserted into alignment guide holes 58 in the upper surface 28 of the insulating support member 20 of the first hermaphroditic terminal assembly 16 and the alignment guide posts 52 disposed through the upper surface 28 of the first hermaphroditic terminal assembly 16 are inserted into alignment guide holes 98 in the upper surface 72 of the insulating support member 68 of the second hermaphroditic terminal assembly 18 to properly align the male pins 34 of the second hermaphroditic terminal assembly 18 with the corresponding female sockets 22 of the first hermaphroditic terminal assembly 16 and the male pins 24 of the first hermaphroditic terminal assembly 16 with the corresponding female sockets 46 of the second hermaphroditic terminal assembly 18. It is appreciated that other alignment elements could be used to facilitate proper alignment of the male pins 34 of the second hermaphroditic terminal assembly 18 with the corresponding female sockets 22 of the first hermaphroditic terminal assembly 16 and the male pins 24 of the first hermaphroditic terminal assembly 16 with the corresponding female sockets 46 of the second hermaphroditic terminal assembly 18. It is also appreciated that alignment elements are not required to properly align the male pins 34 of the second hermaphroditic terminal assembly 18 with the corresponding female sockets 22 of the first hermaphroditic terminal assembly 16 and the male pins 24 of the first hermaphroditic terminal assembly 16 with the corresponding female sockets 46 of the second hermaphroditic terminal assembly 18. In some applications, it may be advantageous for the alignment guide posts 92 disposed through the upper surface 72 of insulating support member 68 of the second hermaphroditic terminal assembly 18 and the alignment guide posts 52 disposed through the upper surface 28 of the first hermaphroditic terminal assembly 16 to serve as power, voltage, or ground connections.

Referring to FIG. 1, first hermaphroditic terminal assembly 16 is identical to second hermaphroditic terminal assembly 18. In order to connect first hermaphroditic terminal assembly 16 to second hermaphroditic terminal assembly 18, second hermaphroditic terminal assembly 18 is rotated 90 degrees so that the male pins 34 of the second hermaphroditic terminal assembly 18 are aligned with corresponding female sockets 22 of the first hermaphroditic terminal assembly 16 and the male pins 24 of the first hermaphroditic terminal assembly 16 are aligned with corresponding female sockets 46 of the second hermaphroditic terminal assembly 18. It is appreciated that the first hermaphroditic terminal assembly 16 need not be identical to the second hermaphroditic terminal assembly 18.

First hermaphroditic terminal assembly 16 is secured to PCB 14 such that the solder balls 38 attached to second ends 36 of the female sockets 22 of the first hermaphroditic terminal assembly 16 and the solder balls 38 attached to second ends 48 of the male pins 24 of the first hermaphroditic terminal assembly 16 are in contact with the electrical contacts 39 on PCB 14. The alignment guide posts 64 disposed through the lower surface 30 of the insulating support member 20 of the first hermaphroditic terminal assembly 16 are inserted into alignment guide holes 128 in PCB 14. It is appreciated that other alignment elements could be used to facilitate proper alignment of the solder balls 38 attached to second ends 36 of the female sockets 22 of the first hermaphroditic terminal assembly 16 and the solder balls 38 attached to second ends 48 of the male pins 24 of the first hermaphroditic terminal assembly 16 with the electrical contacts 39 on PCB 14. It is also appreciated that alignment elements are not required.

When IC package 12 is secured to the lower surface 74 of insulating support member 68 of the second hermaphroditic terminal assembly 18 such that the solder balls 80 on IC package 12 are in contact with the second ends 78 of the female sockets 46 of the second hermaphroditic terminal assembly 18 and the second ends 88 of the male pins 34 of the second hermaphroditic terminal assembly 18; second hermaphroditic terminal assembly 18 is coupled to the first hermaphroditic terminal assembly 16 such that each male pin 34 of the second hermaphroditic terminal assembly 18 is received within a corresponding female socket 22 of the first hermaphroditic terminal assembly 16 and each male pin 24 of the first hermaphroditic terminal assembly 16 is received within a corresponding female socket 46 of the second hermaphroditic terminal assembly 18; and first hermaphroditic terminal assembly 16 is secured to PCB 14 such that that the solder balls 38 attached to second ends 36 of the female sockets 22 of the first hermaphroditic terminal assembly 16 and the solder balls 38 attached to second ends 48 of the male pins 24 of the first terminal assembly 16 are in contact with the electrical contacts 39 on PCB 14, the IC package 12 being electrically connected to PCB 14.

FIGS. 2A and 2B illustrate the operation of intercoupling component 19. The solder balls 38 attached to second ends 36 of the female sockets 22 of the first hermaphroditic terminal assembly 16 and the solder balls 38 attached to second ends 48 of the male pins 24 of the first hermaphroditic terminal assembly 16 are in contact with the electrical contacts 39 on PCB 14. Similarly, the second ends 78 of the female sockets 46 of the second hermaphroditic terminal assembly 18 and the second ends 88 of the male pins 34 of the second hermaphroditic terminal assembly 18 are in contact with the solder balls 80 on IC package 12. Referring to FIG. 2A, IC package 12 and PCB 14 are not electrically connected. Referring to FIG. 2B, intercoupling component 19 is used to electrically connect IC package 12 and PCB 14. The electrical connection between IC package 12 and PCB 14 is formed by inserting each male pin 34 of the second hermaphroditic terminal assembly 18 into a corresponding female socket 22 of the first hermaphroditic terminal assembly 16 and inserting each male pin 24 of the first hermaphroditic terminal assembly 16 into a corresponding female socket 46 of the second hermaphroditic terminal assembly 18.

Figure 3:
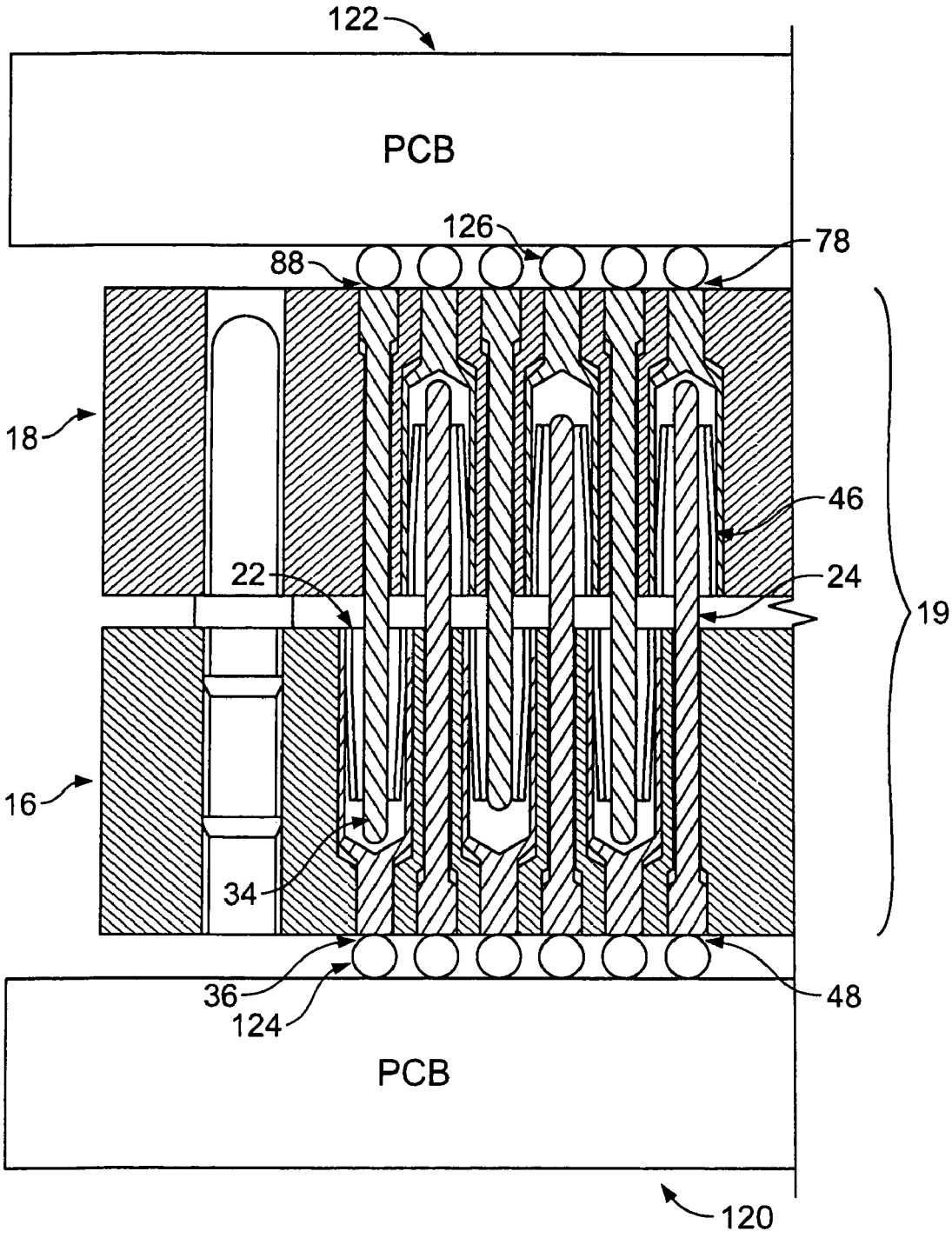
FIG. 3 is a cross-sectional side view of a portion of an alternative embodiment of an intercoupling component.

A number of embodiments of the invention have been described. Nevertheless, it will be understood that various modifications may be made without departing from the spirit and scope of the invention. For example, hermaphroditic terminal assemblies can be used to electrically connect many different types of electrical devices. Referring to FIG. 3, intercoupling component 19, including first hermaphroditic terminal assembly 16 and second hermaphroditic terminal assembly 18, are used to electrically connect a first PCB 120 to a second PCB 122. The second ends 36 of the female sockets 22 of the first hermaphroditic terminal assembly 16 and the second ends 48 of the male pins 24 of the first hermaphroditic terminal assembly 16 are connected to solder balls 124 and form an electrical connection with the electrical contacts 125 on first PCB 120. Similarly, the second ends 78 of the female sockets 46 of the second hermaphroditic terminal assembly 18 and the second ends 88 of the male pins 34 of the second hermaphroditic terminal assembly 18 are connected to solder balls 126 and form an electrical connection with the electrical contacts 127 on second PCB 122. The electrical connection between first PCB 120 and second PCB 122 is formed by inserting each male pin 34 of the second hermaphroditic terminal assembly 18 into a corresponding female socket 22 of the first hermaphroditic terminal assembly 16 and inserting each male pin 24 of the first hermaphroditic terminal assembly 16 into a corresponding female socket 46 of the second hermaphroditic terminal assembly 18. Accordingly, other embodiments are within the scope of the following claims.

What is claimed is:

1. A terminal assembly comprising:

an insulating support member;

a plurality of female contacts disposed in apertures extending through the insulating support member, each female contact having an end with an opening configured to receive a male contact of a corresponding terminal assembly and an opposite end configured to contact a corresponding electrical contact; and a plurality of male contacts disposed in apertures extending through the insulating support member, each male contact having a first end configured to be received within a female contact of a corresponding terminal assembly and an opposite second end configured to contact a corresponding electrical contact, the first ends of the male contacts extending beyond a surface of the insulating support member;

wherein the female contacts and male contacts are disposed in a pattern and at least part of the pattern of female and male contacts comprises a plurality of rows and columns, each row arranged in an alternating sequence of female contacts and male contacts and each column arranged in an alternating sequence of female contacts and male contacts; and the male contacts define a plurality of voids between male contacts, each void extending from a surface of one male contact to a surface of another male contact.

2. The terminal assembly of claim 1 wherein the terminal assembly is of the type used to electrically connect a first circuit board to a second circuit board.

3. The terminal assembly of claim 1 wherein the terminal assembly is of the type used to electrically connect the electrical contacting area of an integrated circuit package to an electrical contacting area of a circuit board.

4. The terminal assembly of claim 1 wherein the height of at least one male contact of the plurality of male contacts is different than the height of every other male contact.

5. The terminal assembly of claim 1 wherein the insulating support member includes at least one alignment element configured to align the plurality of female contacts with a corresponding plurality of male contacts on a corresponding terminal assembly, and to align the plurality of male contacts with a corresponding plurality of female contacts on a corresponding terminal assembly.

6. The terminal assembly of claim 5 wherein the at least one alignment element comprises at least one alignment guide post disposed through the insulating support member to be received by a corresponding alignment hole in a corresponding terminal assembly.

7. The terminal assembly of claim 6 wherein the at least one guide post provides an electrical connection.

8. The terminal assembly of claim 1 wherein the opening of each female contact is disposed within the insulating support member.

9. An intercoupling component comprising:

a first terminal assembly comprising:

a first insulating support member;

a first plurality of female contacts disposed in apertures extending through the first insulating support member; and a first plurality of male contacts disposed in apertures extending through the insulating support member, first ends of the male contacts extending beyond a surface of the first insulating support member;

wherein the first plurality of female contacts and the first plurality of male contacts are disposed in a first pattern and at least part of the first pattern comprises a first plurality of rows and columns, each row a first plurality of rows arranged in an alternating sequence of female contacts and male contacts and each column a first plurality of columns arranged in an alternating sequence of female contacts and male contacts; and wherein the first plurality of male contacts define a first plurality of voids between male contacts, each void extending from a surface of one male contact to a surface of another male contact; and a second terminal assembly comprising:

a second insulating support member;

a second plurality of female contacts disposed in apertures extending through the first insulating support member; and a second plurality of male contacts disposed in apertures extending through the insulating support member, first ends of the male contacts extending beyond a surface of the second insulating support member;

wherein the second plurality of female contacts and the second plurality of male contacts are disposed in a second pattern that is complementary to the first pattern;

wherein each female contact has an end with an opening configured to receive a male contact of a corresponding terminal assembly and an opposite end configured to contact a corresponding electrical contact; and wherein the first end of each male contact is configured to be received within a female contact of a corresponding terminal assembly and each male contact has an opposite second end configured to contact a corresponding electrical contact.

10. The intercoupling component of claim 9 wherein the first terminal assembly is coupled to a first circuit board, and the second terminal assembly is coupled to a second circuit board such that the intercoupling component can be used to electrically connect the first circuit board to the second circuit board.

11. The intercoupling component of claim 9 wherein the first terminal assembly is coupled to the electrical contacting area of an integrated circuit package, and the second terminal assembly is coupled to an electrical contacting area of a circuit board such that the intercoupling component can be used to electrically connect the integrated circuit package to the circuit board.

12. The intercoupling component of claim 9 wherein the first terminal assembly is identical to the second terminal assembly.

13. The intercoupling component of claim 9 wherein the height of at least one male contact of the first plurality of male contacts of the first terminal assembly is different than the height of every other male contact of the first plurality of male contacts of the first terminal assembly; and the height of at least one male contact of the second plurality of male contacts of the second terminal assembly is different than the height of every other male contact of the second plurality of male contacts of the second terminal assembly.

14. The intercoupling component of claim 9 wherein the second insulating support member of the second terminal assembly includes at least one alignment element to align the first plurality of female contacts of the first terminal assembly with the second plurality of male contacts of the second terminal assembly, and to align the first plurality of male contacts of the first terminal assembly with the second plurality of female contacts of the second terminal assembly.

15. The intercoupling component of claim 14 wherein the at least one alignment element comprises at least one alignment guide post disposed through the second insulating support member to be received by a corresponding alignment hole in the first terminal assembly.

16. The intercoupling component of claim 15 wherein the at least one guide post provides an electrical connection.

17. The intercoupling component of claim 9 wherein the first insulating support member of the first terminal assembly includes at least one alignment element to align the first plurality of female contacts of the first terminal assembly with the second plurality of male contacts of the second terminal assembly, and to align the first plurality of male contacts of the first terminal assembly with the second plurality of female contacts of the second terminal assembly.

18. The intercoupling component of claim 17 wherein the at least one alignment element comprises at least one alignment guide post disposed through the first insulating support member to be received by a corresponding alignment hole in the second terminal assembly.

19. The intercoupling component of claim 18 wherein the at least one guide post provides an electrical connection.

20. The intercoupling component of claim 9 further comprising a member configured to apply a force on the intercoupling component.

* * * * *